US006776138B2

(12) United States Patent
Mahr et al.

(10) Patent No.: US 6,776,138 B2
(45) Date of Patent: Aug. 17, 2004

(54) FUEL INJECTION DEVICE

(75) Inventors: Bernd Mahr, Plochingen (DE); Martin Kropp, Tamm (DE); Hans-Chris Magel, Pfullingen (DE); Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/182,919

(22) PCT Filed: Nov. 22, 2001

(86) PCT No.: PCT/DE01/04411

§ 371 (c)(1),
(2), (4) Date: Dec. 24, 2002

(87) PCT Pub. No.: WO02/44540

PCT Pub. Date: Jun. 6, 2002

(65) Prior Publication Data

US 2003/0131824 A1 Jul. 17, 2003

(30) Foreign Application Priority Data

Dec. 1, 2000 (DE) ..... 100 60 089

(51) Int. Cl.[7] ..... F02M 33/04

(52) U.S. Cl. ..... 123/446; 123/447

(58) Field of Search ..... 123/446, 447, 123/456

(56) References Cited

U.S. PATENT DOCUMENTS 4,449,507 A * 5/1984 Mayer ..... 123/467
6,644,282 B2 * 11/2003 Schwarz ..... 123/467
2002/0053340 A1 * 5/2002 Lei ..... 123/446

* cited by examiner

*Primary Examiner*—Thomas N. Moulis
(74) *Attorney, Agent, or Firm*—Ronald E. Greigg

(57) ABSTRACT

A fuel injection apparatus includes a shared pressure reservoir, an injector, a pressure intensifier, and valves for controlling the injection process and the pressure intensification. A modular design is produced by means of a pressure intensifier module, and a valve module, thereby reducing costs and increases flexibility in the manufacture of fuel injection apparatuses.

16 Claims, 4 Drawing Sheets

FUEL INJECTION DEVICE

CROSS-REFERENCE TO RELATED APPLICATIONS

This application is a 35 USC 371 application of PCT/DE 01/04411 filed on Nov. 22, 2001.

BACKGROUND OF THE INVENTION

1. Field of the Invention

The invention relates to an improved pressure-intensified fuel injection apparatus for injecting fuel into the combustion chamber of an internal combustion engine.

2. Description of the Prior Art

Both pressure-controlled and stroke-controlled fuel injection apparatuses are known for supplying fuel in direct-injection diesel engines. In common rail systems, the injection pressure can be adapted to the load and speed and a pre-injection can be used to reduce noise. As a result, the combustion process can be optimally tuned. A high injection pressure is required in order to reduce emissions and to achieve high specific outputs. The achievable pressure level of the pressure reservoir, however, is limited for strength reasons. A further pressure increase of the injection pressure is possible by using a pressure intensifier. Currently, there are known pressure intensifiers, with high intensification ratios of approx. 1:7. In these known pressure-intensified fuel injection apparatuses, the pressure intensifier is disposed in the injector and is controlled by means of a 3/2-port directional-control valve. A fuel injection apparatus of this generic type is known, for example, from EP 0 562 046 B1. In these known injection apparatuses, the pressure intensifier and all of the on/off valves are integrated into the injector, which requires a greater amount of space and results in an overall module that is very expensive to produce. The invention therefore concerns the use and design of a pressure intensifier in a common rail system to increase the injection pressure.

For better comprehension of the specification and the claims, a few terms will be explained below: the fuel injection apparatus according to the invention can be embodied both as stroke-controlled and as pressure-controlled. In the context of the invention, the term stroke-controlled fuel injection apparatus is understood to mean that a movable nozzle needle opens and closes the injection opening as a function of the hydraulic cooperation of the fuel pressures in a nozzle chamber and in a control chamber. A pressure reduction inside the control chamber produces a stroke of the nozzle needle. Alternatively, an adjusting element (actuator) can be used to displace the nozzle needle. In a pressure-controlled fuel injection apparatus according to the invention, the fuel pressure prevailing in the nozzle chamber of an injector moves the nozzle needle counter to the action of the closing force (spring) so that the injection opening is unblocked for an injection of fuel from the nozzle chamber into the cylinder. The pressure with which the fuel emerges from the nozzle chamber into a cylinder of an internal combustion engine is referred to as the injection pressure, whereas a system pressure is understood to be the pressure that prevails in the fuel inside the fuel injection apparatus or at which it is stored in the pressure reservoir. Fuel metering means supplying a definite quantity of fuel for injection. Leakage is understood to be a quantity of fuel, which is generated during operation of a fuel injection apparatus (e.g. a guidance leakage) but not used for injection, and flows into the return. The pressure level of the return can have a standing pressure.

SUMMARY OF THE INVENTION

A fuel injection apparatus according to the invention is proposed in order to reduce manufacturing costs and to increase flexibility in the installation of fuel injection apparatuses.

The use of simple modules permits a favorable series production. To that end, the pressure intensifier in a pressure-intensified fuel injection apparatus (common rail system) is constructed as an individual functional module, which can optionally be integrated into the fuel injection apparatus and can be easily installed in different locations. This permits flexible reaction to the space and installation requirements of the engine manufacturer. Installing the pressure intensifier module at the pressure reservoir, for example, permits the achievement of a very small, compact injector. The modular design permits the production of an injection system module for various engine requirements. Therefore, simpler common rail injection systems without pressure intensification for inexpensive engines (e.g. in small cars) can be comprised of the same components as more expensive, functionally expanded, pressure-intensified systems with a higher injection pressure for high-quality engines. The modular design is possible in both stroke-controlled and pressure-controlled systems.

In order to further increase flexibility, it is possible to divide the pressure intensifier and the associated on/off valves into individual modular blocks (pressure intensifier module and valve module). Then the pressure intensifier module can also be used in other injection systems, for example in a distributor pump. This also makes it possible to place the valve module at the pressure reservoir and the pressure intensifier module at the injector.

In modern injectors, it is standard to provide a lateral high pressure supply by means of an inlet connector. The inlet connector is clamped with a fastening device between the engine and the injector. The high-pressure supply line is then connected to the inlet connector.

It is particularly advantageous to combine the pressure intensifier and the on/off valve of the pressure intensifier for each cylinder into a subassembly module A, that is disposed in the cylinder head so that hydraulic connection to the injector is produced and a connection is formed for the connecting line to the pressure reservoir. Advantageously, the subassembly module A is clamped between the injector and the engine, comparable to the position of the inlet connector that is standard in modern injectors. A seal can be produced between the two modules among other ways by pressing the two modules against each other by means of the component attachment.

If the module comprised of the pressure intensifier and the on/off valve is replaced by an inlet connector, then this produces a normal common rail system without a pressure intensifier. Consequently, the functionality of the injection system can be flexibly adapted to the requirements of various ranges of engine use.

It is also particularly advantageous to combine the injector and pressure intensifier for each cylinder into a subassembly module and to embody the pressure intensifier-on/off valve as a separate subassembly module B. Advantageously, this subassembly module B is then clamped between the injector and the engine, comparable to the position of the inlet connector that is standard in modern injectors. This allows optimal use to be made of the existing space in the cylinder head.

It is also particularly advantageous to combine the injector and the pressure intensifier-on/off valve for each cylinder into a subassembly module and to embody the pressure intensifier as a separate subassembly module C. Advantageously, this subassembly module C is then clamped between the injector and the engine, comparable to the position of the inlet connector that is standard in modern injectors so that a hydraulic connection to the injector is produced and a connection is formed for the connecting line to the pressure reservoir. This allows optimal use to be made of the existing space in the cylinder head and simultaneously produces a lateral high-pressure supply, which permits a favorable connection to the pressure reservoir.

To further reduce costs and increase flexibility, a number of injectors are associated with the same pressure intensifier module and valve module. The reduced number of required pressure intensifier modules permits further reduction of the system costs. In this connection, each injector can be designed to have a minimal dead volume. Connecting a number of injectors in parallel can achieve a dead volume downstream of the pressure intensifier, which dead volume is correct for a system tuning.

BRIEF DESCRIPTION OF THE DRAWINGS

Exemplary embodiments of the fuel injection apparatus according to the invention will be explained in detail herein below, in conjunction with the drawings, in which.

DESCRIPTION OF THE PREFERRED EMBODIMENTS

Figure 1:
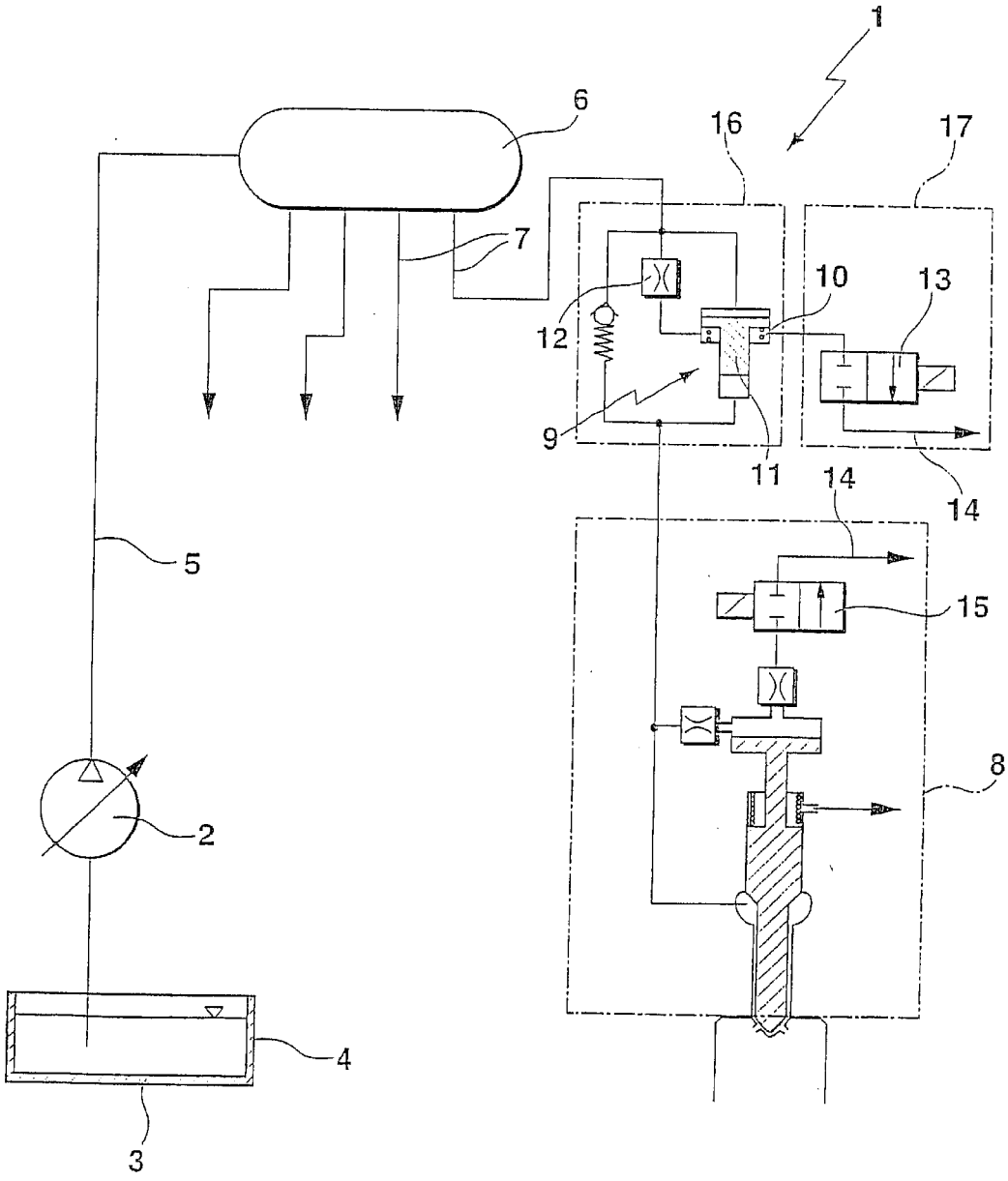
FIG. 1 shows a modular breakdown of a fuel injection apparatus.

FIG. 1 shows the modular design of a stroke-controlled fuel injection apparatus 1. A fuel pump 2 delivers fuel 3 from a tank 4 via a supply line 5 into a central pressure reservoir 6 (common rail) from which a number of pressure lines 7, which corresponds to the number of individual cylinders, leads to the individual injectors 8, which protrude into the combustion chambers of the engine to be supplied. In FIG. 1, only one of the injectors 8 for the respective cylinders is shown in detail. With the aid of the fuel pump 2, an average system pressure is generated and stored in the pressure reservoir 6.

The pressure in the differential pressure chamber 10, which is constituted by a transition from a larger piston cross section to a smaller piston cross section, is used to control a pressure intensifier 9. The differential chamber 10 is subjected to the system pressure (rail pressure) in order to refill and deactivate the pressure intensifier. Then, the same pressure conditions (rail pressure) prevail against all of the pressure surfaces of a piston 11. The piston 11 is pressure balanced. An additional spring presses the piston 11 into its neutral position. In order to activate the pressure intensifier 9, the differential chamber 10 is pressure-relieved and the pressure intensifier 9 generates a pressure intensification in accordance with the area ratio. A throttle 12 and a 2/2-port directional-control valve 13 serve to control the pressure in the differential chamber 10. The throttle 12 connects the differential chamber to fuel under system pressure from the pressure reservoir 6. The 2/2-port directional-control valve 13 closes the differential chamber off from a return line 14.

If the 2/2-port directional-control valves 13 and 15 are closed, then pressure causes the nozzle needle to move into the closed position. The pressure intensifier 9 is disposed in the neutral position. Then, through the opening of the valve 15, an injection at rail pressure can occur. If an injection at a higher pressure is desired, then the 2/2-port directional-control valve 13 is triggered (opened) and as a result, a pressure intensification occurs.

The pressure intensifier 9, throttle 12, and check valve on the one hand and the on/off valve 13 on the other are combined into respective modules 16 and 17. The injector 8 can be thought of as another module. The pressure intensifier module 16 and the valve module 17 can either be attached directly to the injector 8 or they can be installed at the pressure reservoir 6 or at another arbitrary location in the supply line to the injector 8. It is also possible to situate the valve module 17 at the pressure reservoir 6 and the pressure intensifier module 16 at the injector 8.

Figure 2:
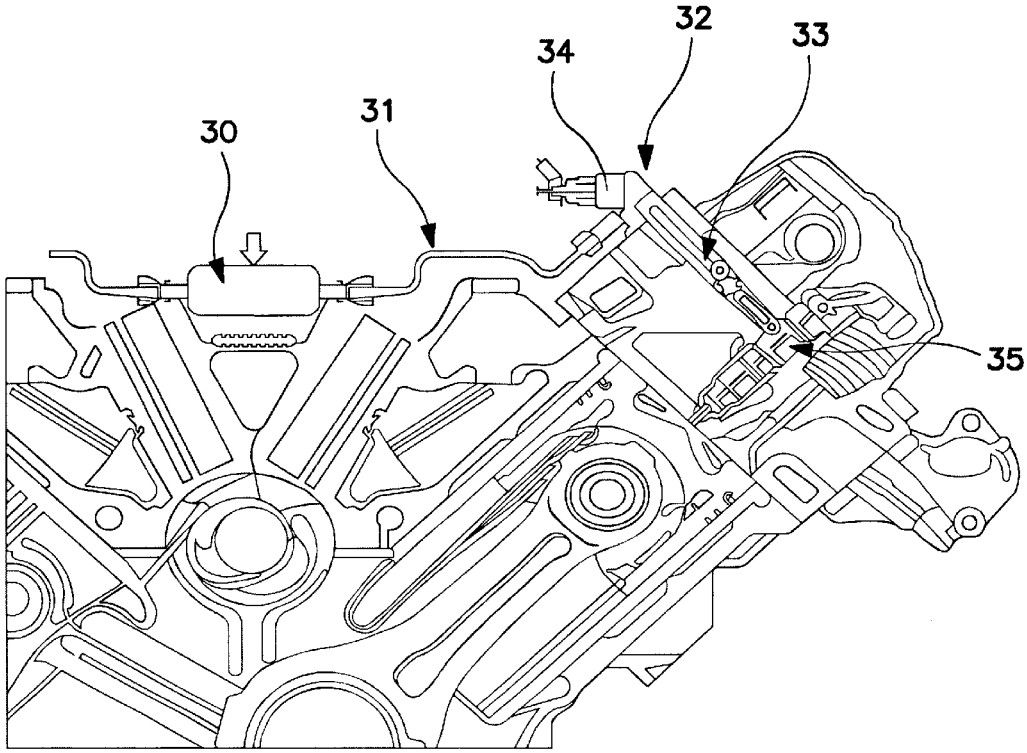
FIG. 2 shows a fuel injection apparatus with a pressure intensifier installed on an internal combustion engine.

FIG. 2 shows a possible embodiment of a pressure-intensified common rail injection system with a modular design. A high-pressure line 31 connects a pressure reservoir 30 to a pressure intensifier module 32. The pressure intensifier module 32 includes a pressure intensifier 33 and an associated on/off valve 34. The injector is embodied as another module 35 and is disposed at right angles to this, centrally above the piston. The pressure intensifier module 32 is disposed at right angles to the injector so that it touches the injector 8 at one end, which produces a hydraulic connection. The seal between the pressure intensifier module 32 and the injector can be produced by pressing the end of the pressure intensifier module 32 against the injector 35. To this end, a clamping device of the pressure intensifier module 32 is provided. Likewise, a screw connection or a thrust transmitting piece can be provided for producing the seal.

Figure 3:
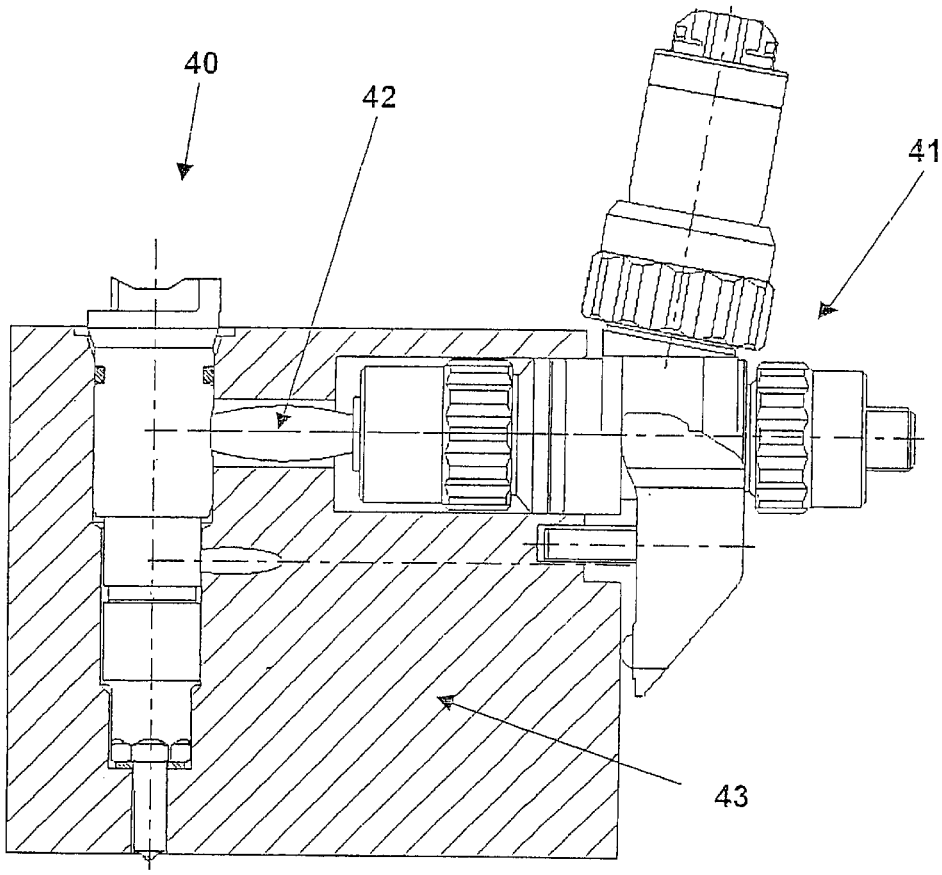
FIG. 3 shows a fuel injection apparatus with a pressure intensifier.

FIG. 3 shows another embodiment of a pressure-intensified common rail injection system with a modular design. The injector is embodied as a separate module 40. The pressure intensifier and pressure intensifier-on/off valve are contained in the module 41. In order to produce the seal between the modules, a short pressure fitting 42 is provided as a separate component, which produces the hydraulic connection between the modules 40 and 41 by means of a bore. In order to produce the seal, an axial force is exerted on the pressure fitting 42. The module 41 is disposed at approximately right angles to the injector 40 and is situated partway inside the engine 43.

Figure 4:
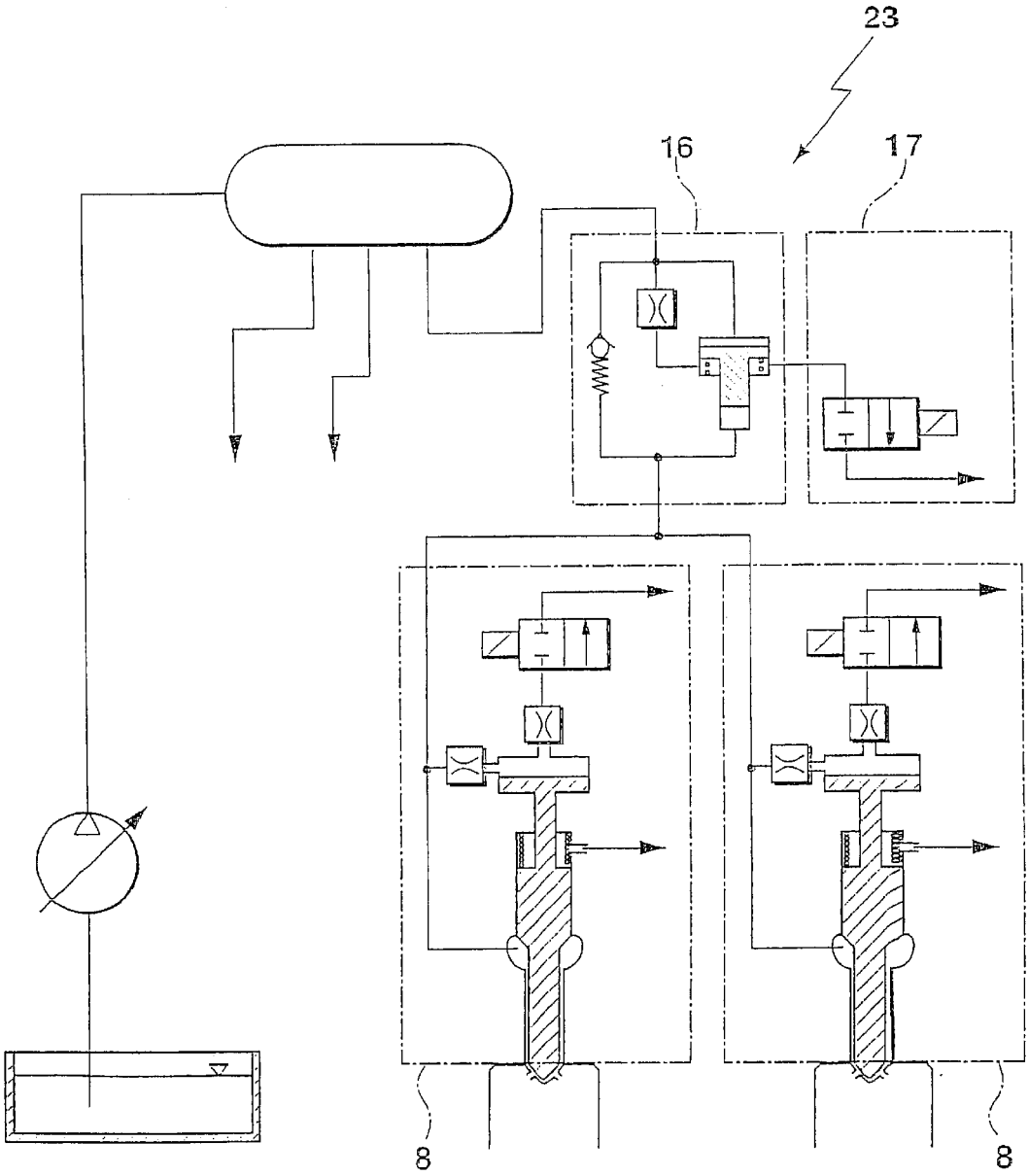
FIG. 4 shows another combination possibility of the modules in a fuel injection apparatus.

FIG. 4 shows that in a fuel injection apparatus 23, two injectors 8 can also be associated with one pressure intensifier module 16 and one valve module 17.

The foregoing relates to preferred exemplary embodiments of the invention, it being understood that other variants and embodiments thereof are possible within the spirit and scope of the invention, the latter being defined by the appended claims.

We claim:

1. In a fuel injection apparatus (1) with a shared pressure reservoir (6), an injector (8), a pressure intensifier (16), and valves (17) for controlling the injection process and the pressure intensification, the improvement wherein a modular design is produced by separating the functional groups of the injector (8), the pressure intensifier (16), and the control valve (17) into at least two separate component modules, wherein the injector (8) and the pressure intensifier (16) are contained in component modules other than the component module which contains the control valve (17).

2. The fuel injection apparatus according to claim 1, wherein, for each cylinder, in addition to the component module which contains the control valve (17), one component module contains the pressure intensifier (16) and another component module contains the injector (8), wherein the separate component modules which contain the pressure intensifier (16) and the injector (8) are mounted in the cylinder head so that a hydraulic connection between these two separate component modules is produced.

3. The fuel injection apparatus according to claim 1, wherein, for each cylinder, one of the component modules which contains the control valve (17) and the component module which contains the pressure intensifier (16) is connected to the pressure reservoir (6) and the other of these component modules is connected to the injector (8).

4. The fuel injection apparatus according to claim 1, wherein, for each cylinder, at least one of the component module which contains the pressure intensifier (16) or the control valve (17) is disposed at the pressure reservoir (6).

5. The fuel injection apparatus according to claim 2, wherein, for each cylinder, at least one of the component module which contains the pressure intensifier (16) or the control valve (17) is disposed at the pressure reservoir (6).

6. The fuel injection apparatus according to claim 3, wherein, for each cylinder, at least one of the component module which contains the pressure intensifier (16) or the control valve (17) is disposed at the pressure reservoir (6).

7. The fuel injection apparatus according to claim 1, wherein, for each cylinder, a component module is embodied which contains the injector (8) and is mounted on the engine, and another separate component module is clamped onto the engine in such a way that a high-pressure-tight hydraulic connection is produced between these two component modules.

8. The fuel injection apparatus according to claim 2, wherein, for each cylinder, a component module which contains the injector (8) is mounted onto the engine, and a second component module which contains at least the pressure intensifier (16) is clamped onto the engine in such a way that a high-pressure-tight hydraulic connection is produced between the two component modules.

9. The fuel injection apparatus according to claim 1, wherein a plurality of injectors (8) are associated with the same pressure intensifier component module (16) and/or the same valve component module (17).

10. The fuel injection apparatus according to claim 2, wherein a plurality of injectors (8) are associated with the same pressure intensifier component module (16) and/or the same valve component module (17).

11. The fuel injection apparatus according to claim 3, wherein a plurality of injectors (8) are associated with the same pressure intensifier component module (16) and/or the same valve component module (17).

12. The fuel injection apparatus according to claim 4, wherein a plurality of injectors (8) are associated with the same pressure intensifier component module (16) and/or the same valve component module (17).

13. The fuel injection apparatus according to claim 5, wherein a plurality of injectors (8) are associated with the same pressure intensifier component module (16) and/or the same valve component module (17).

14. The fuel injection apparatus according to claim 6, wherein a plurality of injectors (8) are associated with the same pressure intensifier component module (16) and/or the same valve component module (17).

15. The fuel injection apparatus according to claim 7, wherein a plurality of injectors (8) are associated with the same pressure intensifier component module (16) and/or the same valve component module (17).

16. The fuel injection apparatus according to claim 8, wherein a plurality of injectors (8) are associated with the same pressure intensifier component module (16) and/or the same valve component module (17).

* * * * *